United States Patent [19]

Schirmer

[11] Patent Number: 4,928,474

[45] Date of Patent: May 29, 1990

[54] OXYGEN-BARRIER RETORT POUCH

[75] Inventor: Henry G. Schirmer, Spartanburg, S.C.

[73] Assignee: W. R. Grace & Co.-Conn., Duncan, S.C.

[21] Appl. No.: 247,202

[22] Filed: Sep. 21, 1988

[51] Int. Cl.[5] ..... B65B 55/06; B65B 11/58

[52] U.S. Cl. ..... 53/425; 53/427; 53/440; 53/449; 426/412; 426/413; 426/415

[58] Field of Search ..... 53/449, 425, 426, 427, 53/140, 173, 440; 426/398, 399, 407, 412, 413, 415, 403

[56] References Cited

U.S. PATENT DOCUMENTS

| | | | |
|---|---|---|---|
| 3,433,694 | 3/1969 | Nuttall | 53/140 X |
| 3,574,642 | 4/1971 | Weinke | 426/413 X |
| 4,190,477 | 2/1980 | Ossian et al. | 156/244.11 |
| 4,355,721 | 10/1982 | Knott et al. | 206/524.2 |
| 4,407,873 | 10/1983 | Christensen et al. | 428/35 |
| 4,467,588 | 8/1984 | Carveth | 53/425 |
| 4,514,446 | 4/1985 | Kadono et al. | 53/449 X |
| 4,526,821 | 7/1985 | McHenry et al. | 428/35 |
| 4,548,852 | 10/1985 | Mitchell | 426/412 X |
| 4,611,456 | 9/1986 | Gillio-Tos et al. | 53/427 |
| 4,734,292 | 3/1988 | Van Boxtel | 53/449 X |
| 4,798,728 | 1/1989 | Sugisawa et al. | 426/415 X |

*Primary Examiner*—Horace M. Culver

*Attorney, Agent, or Firm*—John J. Toney; William D. Lee; Jennifer L. Skord

[57] ABSTRACT

A method of providing oxygen barrier properties to a retorted container is described. A retort container is filled with a product sensitive to spoilage from oxygen contact, such as certain food. The filled container is heat sealed closed, retorted, and then enclosed with a oxygen barrier material.

9 Claims, 5 Drawing Sheets

OXYGEN-BARRIER RETORT POUCH

BACKGROUND OF THE INVENTION

The trend in the food processing industry has been to replace metal cans with heat-sealed containers made from polymeric film for the packaging of certain food products stored under sterile conditions. Medical supplies are also often packaged and used in this manner. This packaging is known as a retort container. The containers may be flexible pouches or rigid trays.

Retort flexible pouches can be made of two sheets of flexible polymeric film heat-sealed on three sides before filling. Then after filling, and then vacuum drawing to remove oxygen from the inside of the pouch, the fourth side, the open-mouth end, is heat-sealed. Alternatively, the pouch can be made from a flexible polymeric tube of film where the bottom end is heat-sealed before filling and then after filling, the open-mouth end is heat-sealed. Also rigid coextruded trays or tubs can be made for use as retort containers.

The requirements of retort packaging include that the filled and sealed package be subjected to sterilizing conditions of high temperature and moisture, i.e. water or steam. Retorting can be from about 250° F. (121° C.) to 300° F. (149° C.) for about 10 minutes to 1 hour, and typical conditions are 275° F. (135° C.) for 0.5 hour, under water (or pressurized steam).

Polypropylene is known to be an excellent sheet material for retort pouches. It holds up well under the hot, moist retort conditions. However, since the pouch of food or medicaments after being retorted is typically stored on the shelf at ambient conditions, the retort pouch should prevent transmission of oxygen so that oxygen does not spoil the contents. Polypropylene has a high oxygen transmission rate. One answer has been to employ a laminate wherein a layer of the retort pouch is aluminum foil to act as a barrier to oxygen coming into the package. Aluminum foil has a zero oxygen transmission rate. A retort pouch having a layer of aluminum foil and a polymeric layer of polypropylene (herein abbreviated as PP) in a laminate is disclosed in U.S. Pat. No. 4,190,477 (1980), Ossian et al assignors to American Can. However, metal foil has three drawbacks. One is that it interferes with visual inspection of the enclosed product. The second is that metals cannot be used in a package for heating food in a microwave oven as the metal will spark in a microwave oven. The third is that metal foil laminates cannot be vacuum formed into rigid trays. An answer has been to make the retort pouch using a polymeric layer of a polymer that is a gas barrier polymer.

"Barrier" polymer refers to a property in some thermoplastic materials which indicates that the particular material has a very low permeability to gases, such as oxygen i.e. a low oxygen transmission rate. One barrier polymeric material is vinylidene chloride copolymer, designated as "PVDC". Vinylidene chloride copolymer is also commonly known as saran which has, in the United States, become generic and is not a registered trademark. Another known barrier polymeric material is acrylonitrile, herein abbreviated as AN. Another is hydrolyzed ethylene-vinyl acetate copolymer, which is also called saponified ethylene-vinyl acetate copolymer or ethylene-vinyl alcohol copolymer or hydrolyzed ethylene-vinyl acetate copolymer. This is designated by the abbreviations: "EVOH" or "HEVA". Sometimes it is referred to as "EVAL" which is a trademark, of Kuraray Co. Ltd. for EVOH.

A retortable package made entirely with polymeric materials and having a polymeric gas barrier layer of ethylene-vinyl alcohol copolymer is disclosed in U.S. Pat. No. 4,407,873 (1983), Christensen et al assignors to American Can. The film layers of the pouch are of the structure: (heat-sealing) linear low density polyethylene/blend of medium density polyethylene with linear low density polyethylene/anhydride modified medium density polyethylene/nylon/ethylene vinyl alcohol/nylon.

EVOH, however, is known to lose its oxygen barrier properties when subjected to moisture. The moist oxygen seeps into the package and spoils the contained food. In recent years, the requirements of the packaging industry have become increasingly demanding and for current commercial purposes, a permeability below 70 cc.mil thickness/$m^2$.atmosphere.day at room temperature (which is equivalent to about 4.5 cc.mil thickness/100 $in^2$.atmosphere.day at room temperature) is expected and a permeability below about 50 cc.mil thickness/$m^2$.atm.day (about 3.2 cc mil thickness/100 $in^2$.atm.day) is highly desirable. Even more preferably the permeability is below about 10 cc.mil thickness/$m^2$.atm.day (about 0.64 cc.mil thickness/100 $in^2$.atm.day). The test for oxygen transmission is conducted as per ASTM D3985.

Dow Chemical Corporation in its sales brochure entitled "Rigid Plastic Barrier Containers for Unrefrigerated Foods" describes the oxygen transmission rate (OTR) for some typical thermoplastic polymers as follows:

| Polymer | Oxygen Transmission cc.mil/100 $in^2$.atm.day |
|---|---|
| PVDC | 0.15 |
| Nylon 66 | 2.0 |
| Nylon 6 | 2.6 |
| Polypropylene | 150 |
| EVOH | 0.01 at 0% relative humidity |
| EVOH | 1.15 at 100% relative humidity |

On page 14 of the brochure is a discussion of Dow's rigid tubs of coextruded sheet containing a saran layer for retort packaging. Dow's laboratory staff tested the oxygen permeability of several containers to illustrate the superior oxygen barrier properties under moisture of saran tubs as compared to EVOH tubs. The layers of the sheet were of the structures: PP/tie layer/EVOH/-tie layer/PP and PP/tie layer/saran/tie layer/PP. (It is noted "tie layer" is another term for "adhesive layer".) The tub containers were filled with hot water, sealed, and retorted under water at 250° F. (121° C.) for 60 minutes at an air overpressure of 21 psig (2.5 kg/$cm^2$). The retorted containers of both types were then emptied and tested for oxygen transmission. The oxygen transmission rate of the EVOH sheet was more than double that of the saran sheet. Furthermore, although the EVOH sheet dried out over time and its oxygen transmission rate decreased, it was still double that of the saran sheet. Clearly due to the retort moisture present, EVOH could not provide the low oxygen transmission rate that saran did.

Also of interest is U.S. Pat. No. 4,355,721 issued Oct. 26, 1982 to Knott et al, assignors to American Can, and U.S. Pat. No. 4,526,821 issued July 2, 1985 to McHenry et al, assignors to American Can. The former discloses flexible, multilayer polymeric retort containers having a core layer of EVOH and the latter discloses rigid, multilayer, polymeric retort containers having a core layer of EVOH. Both discuss the problems with the sensitivity, i.e. increase in $O_2$ transmission rate, of EVOH when it is subjected to moisture.

SUMMARY OF THE INVENTION

To provide a method for retort pouches also to be oxygen barrier pouches, in accordance with this invention a retort container, preferably a flexible polypropylene pouch, is filled with an oxygen-sensitive product subject to spoilage from oxygen contact, such as a food product, evacuated from air, sealed and then retorted. After retorting, the retorted container of food is dried off and cooled to about room temperature. Then, the retorted container is enclosed with an oxygen barrier material, such as with aluminum foil or with a multilayer film having an EVOH barrier layer. The enclosing with the barrier material may be accomplished with an apparatus that evacuates such as a vacuum packaging apparatus or such as a gas flushing apparatus. Also, the enclosing may be accomplished with an apparatus that sprays or dips a barrier emulsion, such as a PVDC emulsion, which when dry will provide an enclosing barrier film. All such apparatus are well known in the art.

Also the invention provides a retorted container filled with a product sensitive to spoilage from oxygen, wherein the container is enclosed with a barrier material. The barrier material is in direct surface-to-surface contact with the outside of the retorted container.

OBJECT OF THE INVENTION

An object of the invention is the provision of an oxygen barrier retorted container, without having subjected the oxygen barrier material to the hot moist retort conditions. It is also an object to provide a method to make such a retorted container enclosed with an oxygen barrier material. The container may be rigid or flexible, and preferably is a flexible pouch such as a polypropylene pouch. While it is known that a PP pouch is very suitable for withstanding the sterilizing process of retorting, a PP pouch is relatively hard. Thus PP pouches are somewhat susceptible to cracking if subjected to rough handling after retorting. Thus a further advantage of the invention is that the enclosing wrap of an oxygen barrier material protects the preferred PP pouch. For instance, the barrier material may be a multilayer film having a barrier layer of PVDC or EVOH and also having a tough abuse resistant outside layer of a material such as high density polyethylene or nylon. Another advantage is avoidance of delamination of the multi-layer barrier film from the hot, moist conditions of retort.

Another advantage is when the oxygen barrier material is an EVOH film, the EVOH has not been subjected to the moisture of the retort which moisture would adversely affect the oxygen permeability of the EVOH by increasing the oxygen transmission rate thereof.

Another advantage is when the oxygen barrier material is a metal foil such as aluminum foil, the package has zero oxygen transmission rate and therefore extremely long shelf life, yet the aluminum can be peeled off and the container then heated in a microwave oven. Moreover, the aluminum foil can enclose a rigid retort tray, whereas as mentioned above retort laminates having an aluminum foil layer cannot be vacuumed formed into a rigid tray.

DETAILED DESCRIPTION OF THE INVENTION

Any container comprising a film suitable for retorting and free of a layer of ethylene-vinyl alcohol copolymer may be employed. The container may be a rigid tray or a flexible pouch.

This discussion reflects the preferred embodiment. It is to be understood that preferably the container comprises a flexible retort pouch PP and that the PP pouch need not be mono-layer. Also, any oxygen barrier material may be employed. Preferably it is aluminum foil, polyvinylidene chloride copolymer film, acrylonitrile film, or ethylene vinyl alcohol copolymer film. More preferably, it is a multilayer film having an EVOH barrier layer, but need not have the particular multilayer structure described. Also, the top web and the bottom web of the multi-layer film need not be the same.

The enclosing is preferably accomplished with a vacuum packaging apparatus. Any vacuum packaging apparatus may be employed. By the term "vacuum packaging" apparatus, it is intended to include but not be limited to "vacuum skin packaging" apparatus. A vacuum packaging apparatus that is not a skin packaging apparatus may be employed; however, a vacuum skin packaging apparatus is preferred as it conforms the film better to the product making a snug fit. Various patents describe vacuum packaging machinery and methods suitable for enclosing the retorted polypropylene pouch with the multilayer film containing an EVOH barrier layer. Representative patents are French Patent No. 1,258,357 (Bresson) (Mar. 6, 1961), French Patent No. 1,286,018 (Laroch Freres, Ltd.) (Jan. 22, 1962), Australian Patent No. 245,774 (Colbro Proprietary Ltd., and Cole and Son Proprietary Ltd.) (July 16, 1963), U.S. Pat. No. 3,491,504 (Young et al) (Jan. 27, 1970), U.S. Pat. No. 3,545,163 (Mahaffy et al) (Dec. 8, 1970), U.S. Pat. No. 3,694,991 (Perdue et al) (Oct. 3, 1972), U.S. Pat. No. 4,537,011 (Bortolani et al) (Aug. 27, 1985), U.S. Pat. No. 4,275,544 (Hisazumi et al) (June 30, 1981), and U.S. Pat. No. 4,611,456 (Gillio-tos et al) (Sept. 16 1986). The disclosures of all of these are incorporated herein by reference.

Also, any retort apparatus may be employed. A suitable one is a 103 gallon capacity unit manufactured by Stock of West Germany.

The figures illustrate the preferred embodiment and it is not intended to limit the invention thereby.

Figure 1:
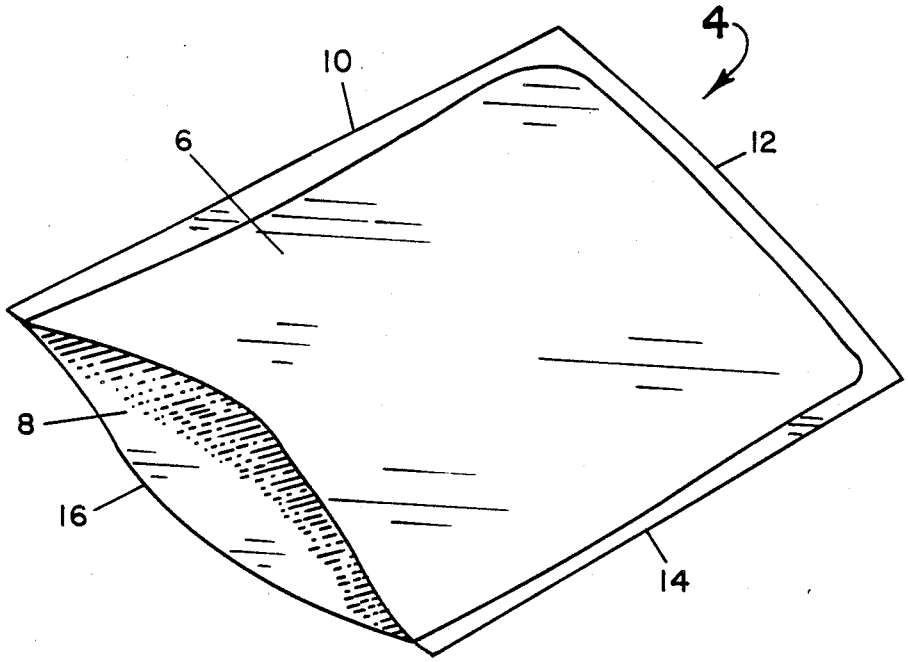
FIG. 1 is a perspective view of an empty polypropylene retort pouch.

FIG. 1 illustrates an empty polypropylene retort pouch 4 having front and back walls 6 and 8 of preferred monolayer polypropylene. The walls are sealed together on three edges 10, 12, and 14, and open on the fourth edge 16 to leave an open mouth end to receive food or medicaments.

Figure 2:
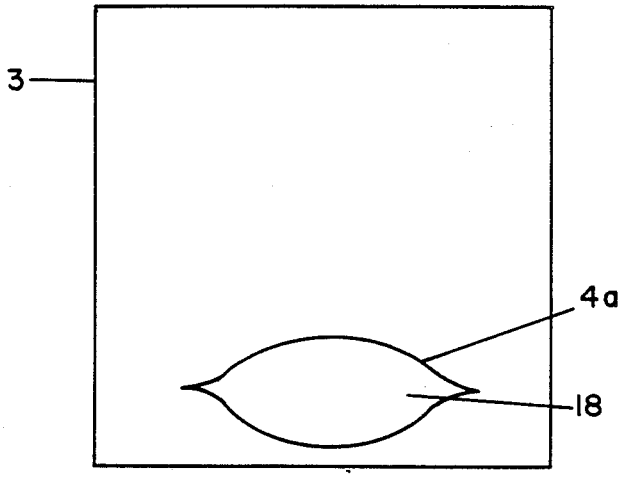
FIG. 2 is a schematic of a retort apparatus retorting the retort pouch of FIG. 1, but wherein the pouch has been filled with food, vacuum drawn to remove residual oxygen, and heat-sealed closed.

Food 18 is then placed in the pouch and the filled pouch is vacuum drawn to remove residual oxygen and then heat sealed on the fourth edge. The filled polypropylene pouch 4*a* filled with the food 18 therein is then retorted in Stock retort 3 at 275° F. (135° C.) for 0.5 hour, under steam, as schematically illustrated in FIG. 2.

Figure 3:
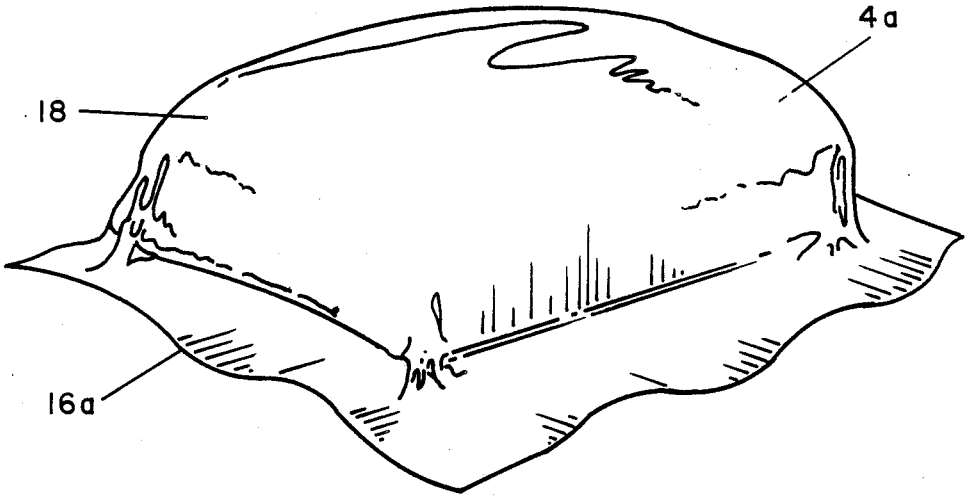
FIG. 3 is the retorted pouch after being removed from the retort apparatus of FIG. 2.

FIG. 3 illustrates filled retorted pouch 4*a* filled with food 18 and having sealed fourth edge 16*a*.

Figure 4:
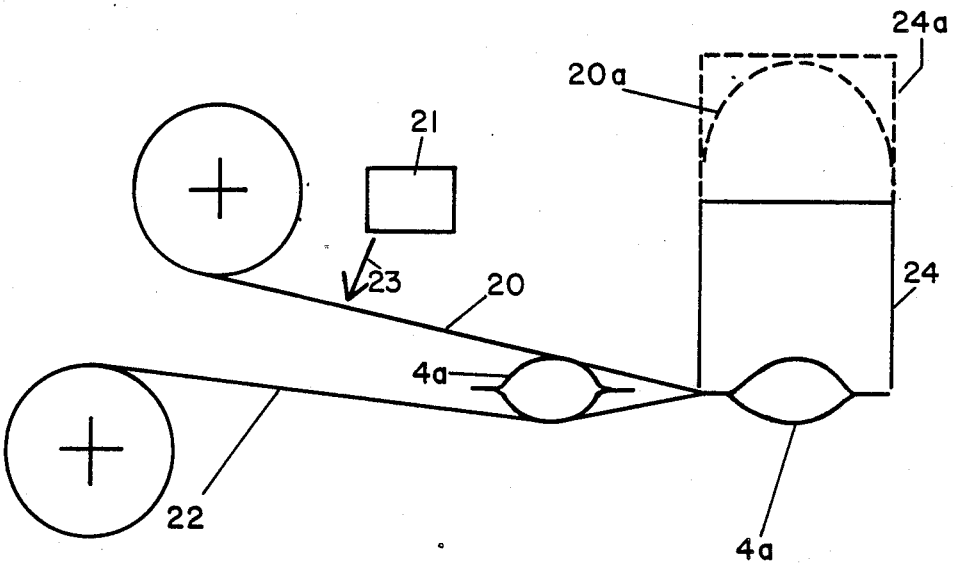
FIG. 4 is a schematic of a skin packaging apparatus enclosing the retorted pouch of FIG. 3 with a barrier film.

The retorted pouch 4*a* is then dried off to remove excess moisture from the retort. Then using a vacuum skin packaging apparatus, schematically illustrated in FIG. 4, filled pouch 4*a* is enclosed with multilayer barrier film as the top forming web 20 and preferably with the same multilayer barrier film as the bottom web 22, making enclosed retorted pouch 4*b* shown in FIG. 5. A heat source 21 transfers heat in the direction of arrow 23 to forming web 20. Vacuum skin packaging chamber 24 is shown in its lowered position, and also illustrated by a broken line in its raised position 24*a*. While the chamber is in its raised position 24*a*, forming web 20 is pulled up by the chamber as illustrated by broken line 20*a*.

Figure 5:
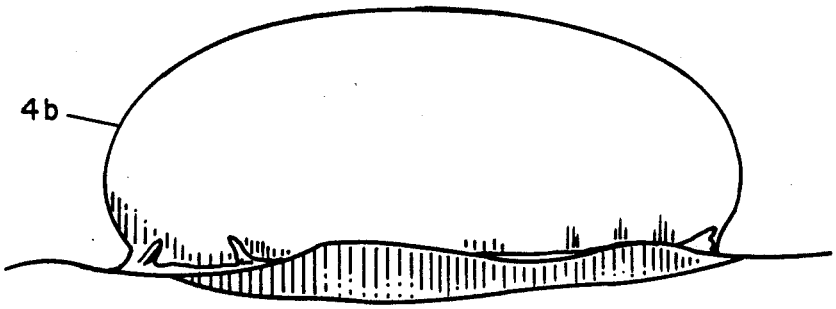
FIG. 5 is a side view of the enclosed retorted pouch.
Figure 6:
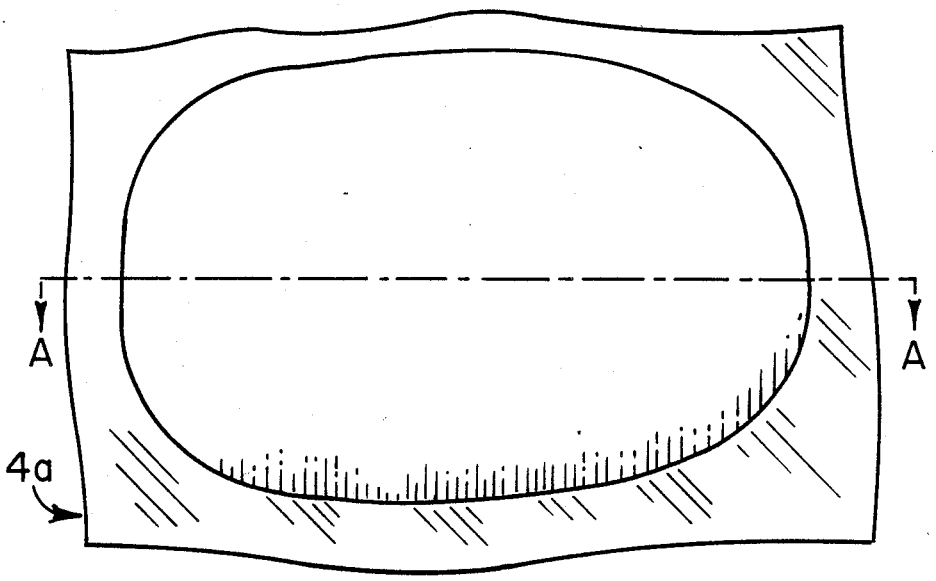
FIG. 6 is a plan view of the enclosed retorted pouch of FIG. 5.

A side view of enclosed retorted pouch 4*b* is shown in FIG. 5 and a top view is shown in FIG. 6. The multilayer film cannot be seen in FIGS. 5 and 6.

Figure 7:
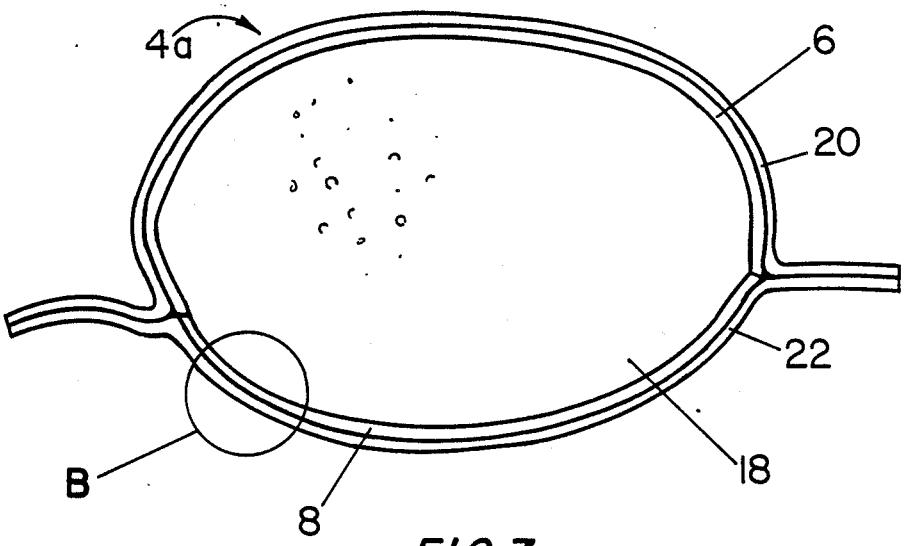
FIG. 7 is a cross-section along a plane defined by line AA in FIG. 6.

Thus to better see the polypropylene and the multilayer film, a cross section along the plane defined by line AA in FIG. 6 is shown in FIG. 7. In FIG. 7 can be seen top wall 6 of polypropylene and bottom wall 8 of polypropylene enclosed with top web 20 of multilayer barrier film and bottom web 22 of multilayer barrier film, respectively.

Figure 8:
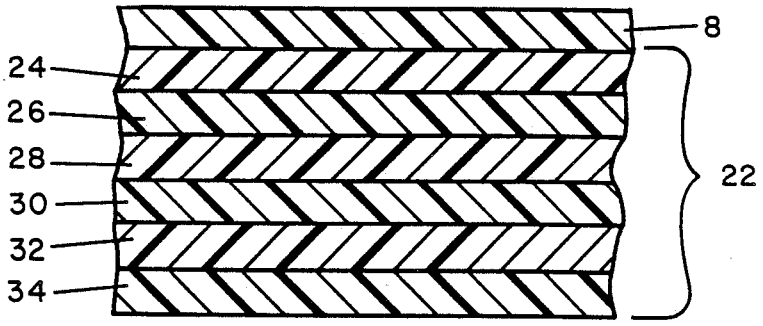
FIG. 8 is a blow up of circle B in FIG. 7 illustrating the film layers.

A blow up of circle B of FIG. 7 is shown in FIG. 8. In FIG. 8, can be seen the preferred polypropylene monolayer film 8 and the preferred multilayer barrier film 22. Film 22 Preferably is a coextruded film comprising the structure: (sealing) layer 24 of EVA/layer 26 of EVA/layer 28 of adhesive/layer 30 of EVOH/layer 32 of adhesive/layer 34 of HDPE (abuse).

The multilayer barrier film is engaged in direct surface-to-surface contact with the outside of the retorted pouch and thus acts as a barrier to oxygen which would permeate the pouch and spoil the food contents thereof.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method of making an oxygen barrier retorted container comprising:

(a) providing a container, (b) filling the container with a product sensitive to spoilage from oxygen content, (c) sealing the filled container, (d) retorting the filled container under moisture at a sterilizing temperature for a sufficient time to sterilize the product, (e) removing excess moisture from the retorted, filled container outside and cooling the retorted, filled container at about room temperature, and (f) enclosing the retorted, filled container with a separate oxygen barrier material.

2. The method of claim 1 wherein the oxygen barrier material and the outside of the retorted container are in direct surface-to-surface contact.

3. The method of claim 1 wherein the oxygen barrier material is selected from ethylene vinyl alcohol copolymer film, vinylidene chloride copolymer film, acrylonitrile film or metal foil.

4. The method of claim 1 wherein the container comprises polypropylene.

5. The method of claim 1 wherein the enclosure is accomplished with an evacuation apparatus selected from a vacuum packaging apparatus or a gas flushing apparatus.

6. The method of claim 1 wherein the enclosing is accomplished with an apparatus for dipping or spraying a barrier material comprising a polyvinylidene chloride copolymer emulsion.

7. An improved method of making an oxygen barrier retorted container, said oxygen barrier comprising a separate film of ethylene-vinyl alcohol copolymer wherein said ethylene-vinyl alcohol copolymer retains an oxygen permeability below about 70 cc.mil/$m^2$.atm.-day at room temperature, said method comprising:

(a) providing a container comprising a film suitable for retorting and free of a layer of ethylene-vinyl alcohol copolymer, (b) filling the container with a product sensitive to spoilage from oxygen contact, (c) heat sealing the filled container, (d) retorting the filled container under moisture at about 250° F. to 300° F. for about 10 to 60 minutes to sterilize the product, (e) removing excess moisture from the retorted, filled container outside and cooling the retorted, filled container to about room temperature, and (f) with a vacuum packaging apparatus, enclosing the retorted, filled container with a separate multilayer barrier film having an ethylene-vinyl alcohol barrier layer, the container outside and the separate barrier film being in direct surface-to-surface contact.

8. The method of claim 7 wherein the barrier film includes an outside abuse layer of nylon or high density polyethylene.

9. A method of making an oxygen barrier retorted container, wherein said oxygen barrier comprises a separate film of ethylene-vinyl alcohol copolymer, said method comprising employing a vacuum packaging apparatus to enclose a retorted, filled container with a multi-layer barrier film having an ethylene-vinyl alcohol barrier layer, the retorted filled container having been provided by a container of film suitable for retorting filled with a product sensitive to oxygen spoilage, and evacuated and heat sealed, and then retorted, whereby the oxygen barrier retains an oxygen permeability below about 70 cc.mil/$m^2$ atm.day at room temperature.

* * * * *

UNITED STATES PATENT AND TRADEMARK OFFICE

CERTIFICATE OF CORRECTION

PATENT NO. : 4,928,474

DATED : 5/29/90

INVENTOR(S) : Henry G. Schirmer

It is certified that error appears in the above-identified patent and that said Letters Patent is hereby corrected as shown below:

In column 5, line 65, change "content" to read as --contact--.

In column 6, line 6, change "at" to read as --to--.

Signed and Sealed this

Second Day of July, 1991

*Attest:*

HARRY F. MANBECK, JR.

*Attesting Officer*

*Commissioner of Patents and Trademarks*